US005570999A

United States Patent [19]

Moon

[11] Patent Number: 5,570,999

[45] Date of Patent: Nov. 5, 1996

[54] ELECTROMAGNETIC PUMP HAVING AN AUTOMATIC EXHAUST-CONTROL VALVE

[75] Inventor: Sung-Dai Moon, Kyeongsangbuk-do, Rep. of Korea

[73] Assignee: Daewoo Electronics Co., Ltd., Seoul, Rep. of Korea

[21] Appl. No.: 412,336

[22] Filed: Mar. 31, 1995

[30] Foreign Application Priority Data

Mar. 31, 1994 [KR] Rep. of Korea ..... 94-6715
Mar. 31, 1994 [KR] Rep. of Korea ..... 94-6718

[51] Int. Cl.[6] ..... F04B 49/00

[52] U.S. Cl. ..... 417/307; 417/311; 417/417

[58] Field of Search ..... 417/417, 303, 417/296, 297, 311, 307; 137/509

[56] References Cited

U.S. PATENT DOCUMENTS

| | | | |
|---|---|---|---|
| 3,877,841 | 4/1975 | Nakamura | 417/311 |
| 4,021,152 | 5/1977 | Toyoda | 417/417 |
| 4,169,695 | 10/1979 | Masuda | 417/311 |
| 4,201,522 | 5/1980 | Toyota et al. | 417/311 |
| 4,255,094 | 3/1981 | Nomura | 417/311 |
| 4,431,381 | 2/1984 | Falendysz et al. | 417/307 |
| 4,620,562 | 11/1986 | Pacht | 137/509 |
| 4,955,408 | 9/1990 | Meermoller | 137/509 |
| 5,165,871 | 11/1992 | Iwabuchi | 417/417 |

*Primary Examiner*—Timothy S. Thorpe
*Assistant Examiner*—Ted Kim
*Attorney, Agent, or Firm*—Fish & Richardson, P.C.

[57] ABSTRACT

Disclosed is an electromagnetic pump, in which oil is exhausted not intermittently but constantly with small pressure fluctuations, with reduced operational noise, with reduced fire-extinction delay, and improved energy efficiency. The electromagnetic pump has an automatic exhaust-control valve having a conical head, and a cylindrical body having a tapered shape whose diameter decreases rearward from the conical head. According to change of a sectional area of an oil path defined between the exhaust-control valve and an exhaust chamber, the exhaust-control valve transmits an elevated pressure of pressurized oil to a development section to thereby automatically control its pressure elevating capability.

9 Claims, 8 Drawing Sheets

10

ELECTROMAGNETIC PUMP HAVING AN AUTOMATIC EXHAUST-CONTROL VALVE

BACKGROUND OF THE INVENTION

1. Field of the Invention

The present invention relates to an electromagnetic pump, and more particularly to an electromagnetic pump having an exhaust-control valve by which the quantity and pressure of exhausted oil can be maintained constant by automatically controlling the pressurizing of the oil.

2. Prior Art

An electromagnetic pump is an appliance for supplying fluid, and is generally used for supplying oil to a burner in a boiler system.

FIG. 7 is a hydraulic circuit diagram of a conventional electromagnetic pump 10. As shown in FIG. 7, electromagnetic pump 10 has a suction section 20 for introducing oil from an oil tank 12, a development section 30 for increasing the pressure of the introduced oil, and an exhaust section 40 for exhausting the oil pressurized through development section 30.

Suction section 20 includes a suction nozzle 22 interconnected to oil tank 12 so as to receive oil therefrom, and a suction filter 24 interconnected through a first oil path 61 to suction nozzle 22.

Development section 30 includes a suction check valve 32 interconnected to suction filter 24 so as to receive oil therefrom, an exhaust check valve 34 interconnected through a second oil path 62 to suction check valve 32, and an actuating section 31 for pressurizing the oil having been introduced through suction check valve 32 and exhausting the pressurized oil through exhaust check valve 34.

Exhaust section 40 includes an exhaust valve 44 for intermittently exhausting oil having been introduced through a fifth oil path 65 from development section 30 into a burner (not shown), an exhaust nozzle 48 for guiding the pressurized oil having passed exhaust valve 44 into the burner, and a relief valve 42 for controlling the pressure of the exhausted oil. One end of relief valve 42 is interconnected to a sixth oil path 66 branched out from fifth oil path 65, while the other end of relief valve 42 is connected to a seventh oil path 67 branched out from first oil path 61.

FIGS. 8 and 9 are side and plan sectional views of the conventional electromagnetic pump as shown in FIG. 7.

As shown in detail in FIG. 8, actuating section 31 includes a hollow first cylinder 36. First cylinder 36 has a bobbin 55, a support plate **55*a* disposed beneath bobbin 55 and in close contact therewith, and a hollow second cylinder 37 fitted in a hole formed at a lower part thereof. Second cylinder 37 has a smaller diameter than that of first cylinder 36**.

Bobbin 55 has a solenoid 54 wound on an outer surface thereof. A cap **55*b* enclosing bobbin 55 and solenoid 54 is disposed on support plate 55*a***.

First cylinder 36 further has a magnetic core 56 secured in bobbin 55, and a stopper 45 and a plunger assembly 51 movably disposed above and under magnetic core 56, respectively.

Plunger assembly 51 includes a plunger 52 and a piston 53 formed integrally with plunger 52 and extended downward thereof. One end of piston 53 is inserted in second cylinder 37 so as to move up and down therein. A first space and a second space 71 and 72 isolated from each other by piston 53 are formed under and above second cylinder 37, respectively. A first spring 57 is disposed between magnetic core 56 and plunger 52, and a second spring 58 is disposed between plunger 52 and the bottom of first cylinder 36. Also, a third spring 59 is disposed between magnetic core 56 and stopper 45.

A stopper seat 46 is disposed above stopper 45. Stopper 45 and stopper seat 46 constitute exhaust valve 44 as mentioned above. When stopper 45 is at its uppermost position, it engages with stopper seat 46 so as to close exhaust nozzle 48, while exhaust nozzle 48 is open when stopper 45 is moved downward from the uppermost position.

Referring again to FIG. 7, first space 71 formed under piston 53 is interconnected to a third oil path 63 branched out from second oil path 62, and exhaust check valve 34 is interconnected through fourth oil path 64 with second space 72 formed above piston 53. In addition, both an air bleeder valve 38 for exhausting air contained in pressurized oil and a buffer 39 for reducing fluctuation of exhaust of pressurized oil are branched out from fourth oil path 64. Second space 72 formed above piston 53 is interconnected with exhaust valve 44 through fifth oil path 65.

Referring to FIG. 9, relief valve 42 is supported by a fourth spring 43 and biasing force of fourth spring 43 can be preset and adjusted by means of an adjuster 47.

In the conventional electromagnetic pump having the above described construction, oil is pumped as follows.

First, when electric power is applied to solenoid 54, magnetic core 56 is magnetized so that plunger assembly 51 is elevated toward magnetic core 56. At this moment, the volume of first space 71 is expanded so that the pressure in second oil path 62 connected thereto is decreased. Then, suction check valve 32 is open and exhaust check valve 34 is closed, while oil is supplied to second oil path 62 from oil tank 12 through suction nozzle 22, first oil path 61, suction filter 24, and suction check valve 32. At the same time, stopper 45 is lowered toward magnetic core 56 so that exhaust valve 44 is open. To ensure the alternating of both stopper 45 and plunger assembly 51 by magnetic force, bobbin 55 is made from non-magnetic material and both support plate **55*a* and cap 55*b*** are made from magnetic material.

Meanwhile, when electric power having been applied to solenoid 54 is cut-off, plunger assembly 51 moves downward by means of biasing force of first spring 57. In this case, second spring 58 keeps plunger assembly 51 from being excessively pushed downward in first cylinder 36, so that plunger assembly 51 can be maintained in the range of electromagnetic force of magnetic core 56.

As plunger assembly 51 moves downward, the volume of first space 71 is reduced so that the pressure in second oil path 62 interconnected thereto is increased. Accordingly, suction check valve 32 is closed and exhaust check valve 34 is open, while the oil pressurized in first space 71 is flowed through exhaust check valve 34 and fourth oil path 64 into second space 72. Then, the pressurized oil is flowed from second space 72 through fifth oil path 65 into exhaust valve 44. Air contained in pressurized oil can be exhausted through air bleeder valve 38 while passing through fourth oil path 64. On the other hand, stopper 45 is moved up again and engaged with stopper seat 46 so that exhaust valve 44 is closed again by means of the biasing force of third spring 59.

When exhaust valve 44 is re-open by applying an electric power to solenoid 54, oil having passed through fifth oil path 65 is exhausted through exhaust nozzle 148 to the exterior of the electromagnetic pump, i.e., to the burner.

The above-described process is periodically repeated whenever such applying and cutting off of an electric power alternates. The exhaust pressure of oil is increased according to this periodical repetition. When the exhaust pressure having been increased exceeds a preset biasing force of fourth spring 43 for supporting relief valve 42, relief valve 42 is pushed backward while compressing fourth spring 43. At this moment, sixth and seventh oil paths 66 and 67 are interconnected to each other so that some of the pressurized oil is returned to first oil path 61 through sixth and seventh oil paths 66 and 67, and thereby the exhaust pressure in exhaust valve 44 decreases.

When the exhaust pressure goes down below the biasing force of fourth spring 43, relief valve 42 moves forward again and is returned to the initial position so that sixth and seventh oil paths 66 and 67 are blocked off again from each other, and thereby the exhaust pressure is increased again. In this way, exhaust pressure of the electromagnetic pump is equilibrated at a pressure which can be predetermined by setting up biasing force of fourth spring 43 supporting relief valve 42. By means of adjuster 47, the predetermined pressure can be adjusted.

However, the conventional electromagnetic pump having the above construction has disadvantages as follows.

First, the exhaust of oil is highly pulsative since the pressurized oil is exhausted through exhaust valve 44 which is intermittently open and closed according to the operation of solenoid 54. For this reason, a separate element for reducing pulsation of exhaust oil such as buffer 39 is required.

Further, since alternating current over 60 Hz is generally used as an electric source, stopper 45 should move up and down by a very high speed over 60 times per second so that impact noise between stopper 45 and magnetic core 56 can be generated.

Furthermore, the biasing force of third spring 59 supporting stopper 45 is set irrespective of the pressure of the exhausted oil. For this reason, even after the operation of exhaust valve 44 has been finished, exhaust valve 44 may not be closed completely so that oil of low pressure may leak therethrough to the burner. The oil having low pressure leaked to the burner is not sufficiently vaporized, so it is not completely burned and thereby makes a bad smell after the running of burner has been finished. That is, incomplete combustion happens in the burner after the running of the burner has been finished, which is so-called "a fire-extinction delay" phenomenon.

In addition, since both exhaust valve 44 and exhaust nozzle 48 are disposed in an upper portion of first cylinder 36, air contained in the pressurized oil is concentrated in exhaust valve 44 due to the difference of viscosity between the pressurized oil and air. The concentrated air, unlike oil, can not dampen the operation of stopper 45 so that the impact noise by stopper 45 is further increased.

Moreover, the larger a gap between stopper 45 and an upper wall **36*a* of first cylinder 36** is, the more the oil leaks therethrough, while the smaller the gap is, the louder the operating noise would be. Accordingly, it is impossible to solve the problems of noise and leakage simultaneously.

Further, an excessive pressure of the exhausted oil over a predetermined value is wasted in the conventional electromagnetic pump. That is, when the exhaust pressure exceeds a predetermined value, a part of the exhausted oil is returned through seventh oil path 67 to first oil path 61 and is recirculated in the electromagnetic pump so as to control the exhaust pressure. Accordingly, there is waste of energy for recirculating such redundant oil.

Furthermore, the magnetic flux or the magnetic force is transferred from solenoid 54 to magnetic core 56 through magnetic support plate **55*a* and magnetic cap 55*b*, and thereby it may be weakened due to upper wall 36*a* of first cylinder 36** which is made of non-magnetic material so as to act as a magnetic void. This weakened magnetic force may also result in waste of energy.

SUMMARY OF THE INVENTION

The present invention has been made to overcome the above-described problems of the prior arts, and accordingly it is an object of the present invention to provide an electromagnetic pump, in which oil is exhausted not intermittently but constantly with small pressure fluctuation, operational noise is reduced, fire-extinction delay is reduced, and energy efficiency is improved.

To achieve the above object, the present invention provides an electromagnetic pump comprising:

a suction section for introducing oil from an oil reservoir;

a development section for pressurizing the oil introduced from the suction section so as to elevate pressure of the oil; and an exhaust section for sensing the elevated pressure of the oil pressurized in the development section, and for transmitting the elevated pressure to the development section to thereby control a pressure elevating capability of the development section so as to exhaust the oil having a constant pressure.

Preferably, the suction section has a suction nozzle interconnected to the oil reservoir for introducing the oil, and a suction filter coupled to the suction nozzle via a first oil path.

The development section may have a suction check valve for receiving the oil introduced from the suction section, an exhaust check valve for exhausting the oil from the suction check valve, the exhaust check valve being interconnected to the suction check valve via a second oil path, and an actuating section for pressurizing the oil introduced through the suction check valve so as to increase the pressure of the oil and for exhausting the oil through the exhaust check valve.

The actuating section may have a first cylinder of a hollow type, a plunger assembly movably provided in the first cylinder, means for reciprocating the plunger assembly up and down in the first cylinder, and a first space open to the second oil path and a second space open to the exhaust check valve so as to receive the oil from the exhaust check valve, the first space and the second space having volumes which vary alternatively from each other in accordance with the reciprocating movement of the plunger assembly.

The first cylinder may have a bobbin, a support plate integrally assembled with a lower portion of the bobbin, a first neck integrally assembled with a lower portion of the support plate, and a cap provided on an upper portion of the support plate so as to cover the bobbin and the solenoid.

The reciprocating means may have a magnetic core fixed above the plunger assembly in the bobbin, a solenoid wound on an outer surface of the bobbin for generating a magnetic force of the magnetic core to thereby move the plunger assembly when an electric current is applied thereto, a first spring provided between the magnetic core and the plunger assembly for applying the plunger assembly with a biasing force, and a second spring provided between the plunger assembly and an inner surface of the first cylinder for applying the first cylinder with an biasing force so as to maintain the plunger assembly within a magnetic range of the magnetic core.

The first cylinder may further have a second cylinder fixed to a lower portion thereof, wherein the second cylinder has a diameter less than that of the first cylinder, and the plunger assembly has a plunger and a piston integrally connected to the plunger and being extended from a center portion of the plunger, the piston being inserted in the second cylinder so as to reciprocate in the second cylinder.

The first space and the second space are respectively formed at both ends of the second cylinder, and the first space and the second space are isolated from each other by the piston.

The exhaust section may have means for controlling the pressure elevating capability of the development section by transmitting the elevated pressure to the development section to thereby maintain a constant exhaust pressure, an exhaust nozzle for guiding exhaust of the oil which has passed the controlling means, and setting means for setting and adjusting the exhaust pressure which is maintained constant by the controlling means.

It is preferred that the controlling means has an exhaust chamber having a first end open to the development section via a fifth oil path so as to receive the oil from the development section and a second end open to the exhaust nozzle, and an exhaust-control valve disposed within the exhaust chamber.

The exhaust-control valve may have a conical head at one end side, a cylindrical body integrally connected to the conical head, the cylindrical body having a tapered shape whose diameter decreases as it goes to a rear side from the conical head, a threshold between the conical head and the cylindrical body, and a guide tail integrally connected to a rear side of the cylindrical body for guiding reciprocating movement of the exhaust-control valve.

The exhaust chamber has a second neck formed between the exhaust chamber and the fifth oil path, the second neck having a diameter less than that of the exhaust chamber, and the body is located in the second neck so that a sixth oil path is formed between the body and the second neck, a sectional area of the sixth oil path being varied in accordance with the reciprocating movement of the exhaust-control valve.

The setting means may have a back pressure chamber isolated from the exhaust chamber, a third spring provided within the back pressure chamber for applying a biasing force to the exhaust-control valve, and an adjustor for adjusting the biasing force of the third spring.

A cylindrical guide hole may be formed between the exhaust chamber and the back pressure chamber, and the guide tail is inserted in the cylindrical guide hole to be guided therein while being in close contact therewith so that the exhaust chamber and the back pressure chamber are isolated from each other. The back pressure chamber may be open to the suction section via a seventh oil path.

Meanwhile, according to another aspect of the present invention, exhaust check valve may be integrally provided at an upper portion of the plunger assembly, the first space constituting a part of the second oil path.

In an electromagnetic pump according to the present invention, when electric power is intermittently applied to the solenoid, the plunger assembly moves reciprocally and the suction check valve and the exhaust check valve are alternatively open and closed, and accordingly the pressure of the oil flowing through the suction section and the development section from the oil reservoir is increased.

According to this continuous pressure increase, the front face of the conical head is forced backward. When the pressure of the oil in the exhaust chamber having been increased exceeds the sum of the initial compression force of the third spring and the back pressure, the exhaust-control valve is moved backward while forcing the third spring.

According to the backward movement of the exhaust-control valve, a sectional area in the sixth oil path decreases, and accordingly the oil pressure applied to the conical head decreases.

When the oil pressure having been decreasing becomes lower than a sum of the back pressure and a control compression force of the third spring, the exhaust-control valve moves forward again. At this point, the sectional area of the sixth oil path increases again and accordingly the oil pressure applied to the conical head increases again.

While the oil is exhausted through the exhaust nozzle, the exhaust-control valve repeats such a minute forward and backward movement as described above, so as to maintain the pressure of the exhausted oil constant. Further, the exhaust pressure of the oil is transmitted to the development section, and accordingly energy for pressurizing the oil is saved.

Meanwhile, when the operation of the electromagnetic pump is stopped and a burner connected thereto is extinguished, the exhaust-control valve moves forward and tightly blocks off the exhaust nozzle by means of the third spring having a very large compression force, and thereby the remaining oil of low pressure does not leak into the exhaust nozzle but only remains in the exhaust chamber and the fifth oil path due to such a large compression force. Therefore, leakage of remaining oil after extinction of a burner is prevented, and thereby incomplete combustion is prevented.

BRIEF DESCRIPTION OF THE DRAWINGS

The above objects and other advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings.

Figure 1:
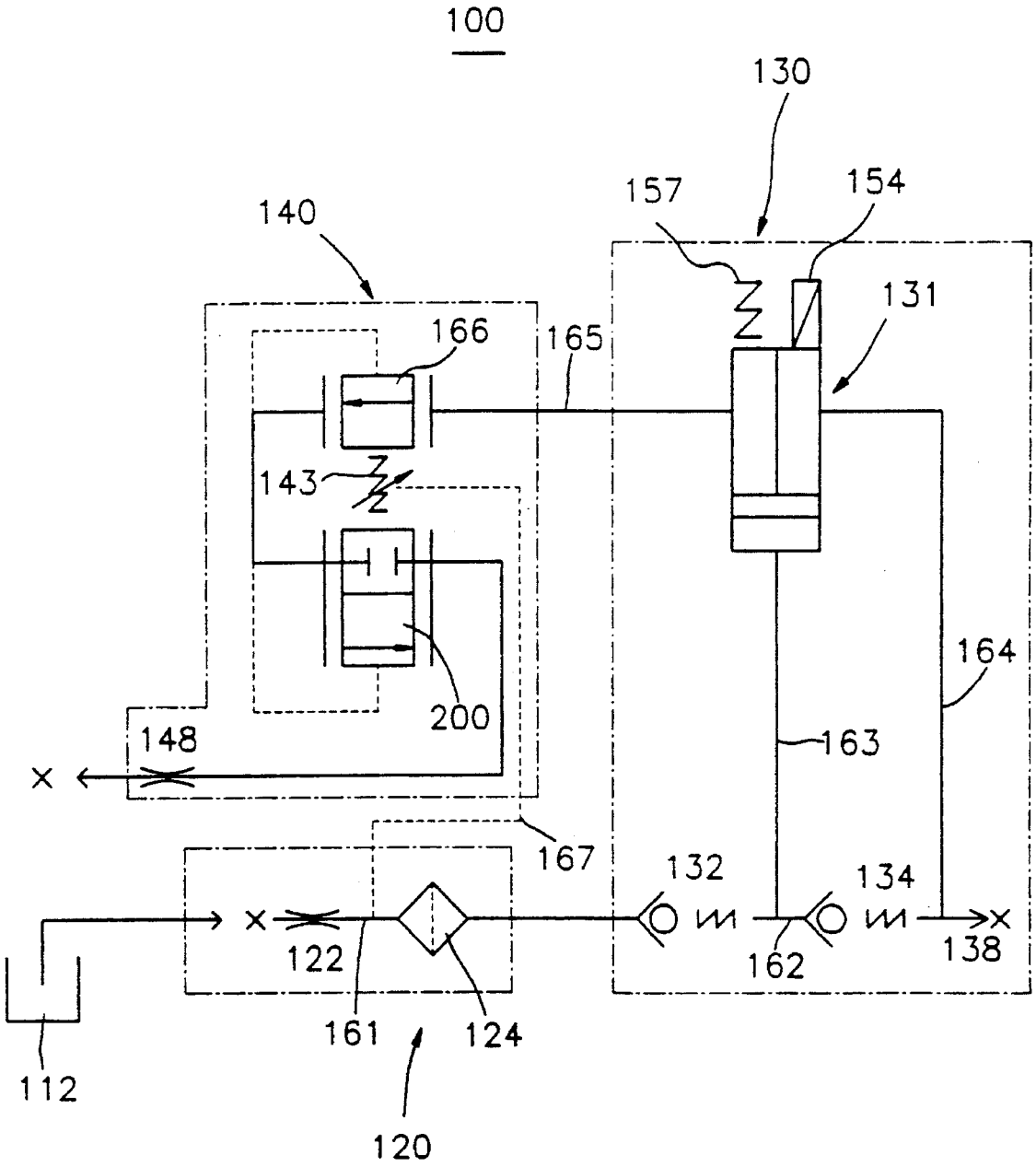
FIG. 1 is a hydraulic circuit diagram of an electromagnetic pump according to an embodiment of the present invention.

FIG. 1 is a hydraulic circuit diagram of an electromagnetic pump 100 according to one embodiment of the present invention. As shown in FIG. 1, an electromagnetic pump 100 has a suction section 120 for introducing oil from an oil tank 112, a development section 130 for increasing the pressure of the introduced oil, and an exhaust section 140 for exhausting the oil pressurized through development section 130.

Suction section 120 includes a suction nozzle 122 interconnected to oil tank 112 so as to receive oil therefrom, and a suction filter 124 interconnected through a first oil path 161 to suction nozzle 122.

Development section 130 includes a suction check valve 132 interconnected to suction filter 124 so as to receive oil therefrom, an exhaust check valve 134 interconnected through a second oil path 162 to suction check valve 132, and an actuating section 131 for pressurizing the oil having been introduced through suction check valve 132 and exhausting the pressurized oil through exhaust check valve 134.

Exhaust section 140 includes an exhaust-control valve 200 for responding to the oil having been introduced through a fifth oil path 165 from development section 130 so as to control quantity and pressure of the exhausted oil, an exhaust nozzle 148 for guiding the pressurized oil having passed through exhaust-control valve 200 into the burner, and a third spring 143 for applying an adjustable biasing force to exhaust-control valve 200.

Figure 2:
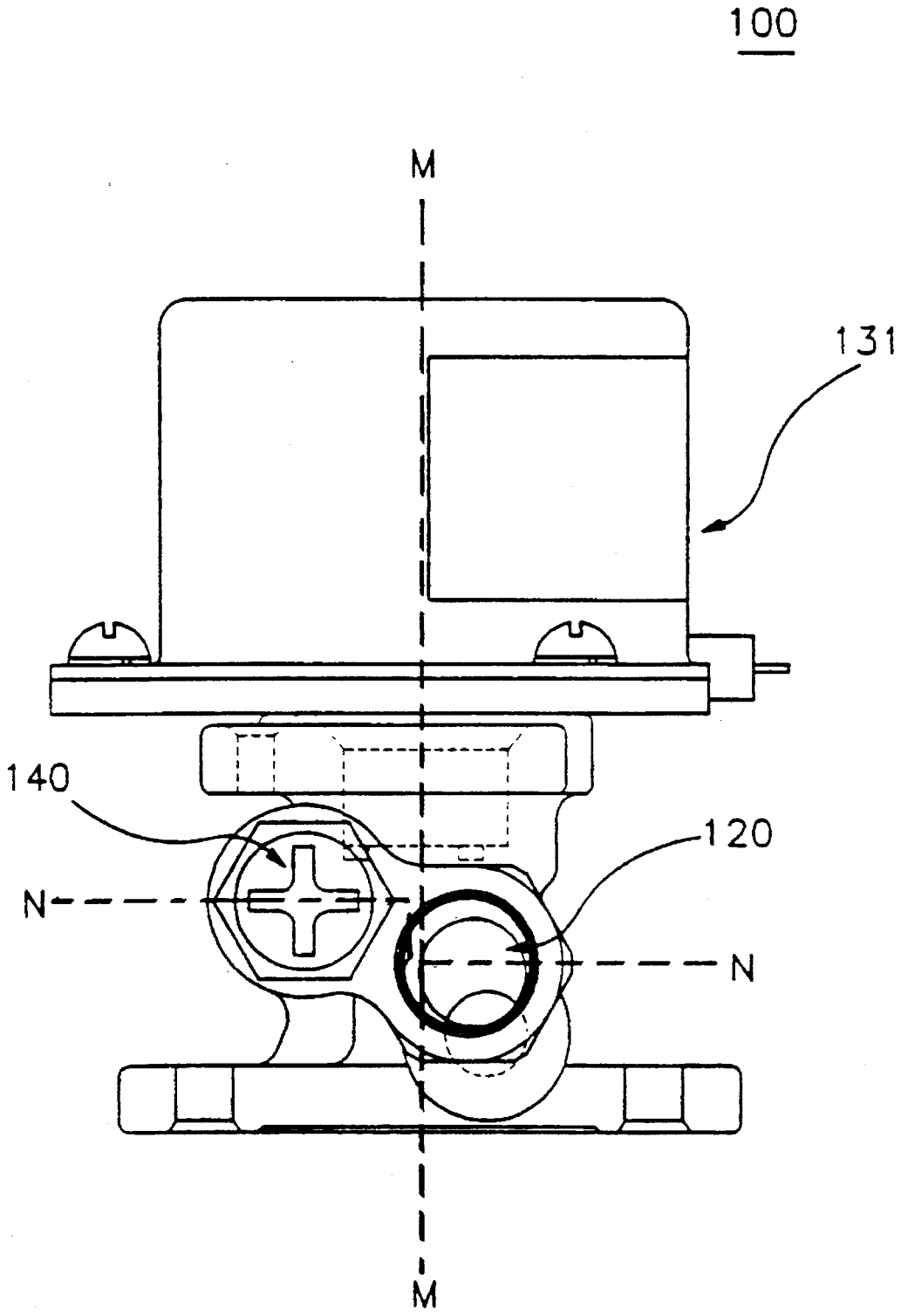
FIG. 2 is a side elevation view of the electromagnetic pump as shown in FIG. 1.
Figure 3:
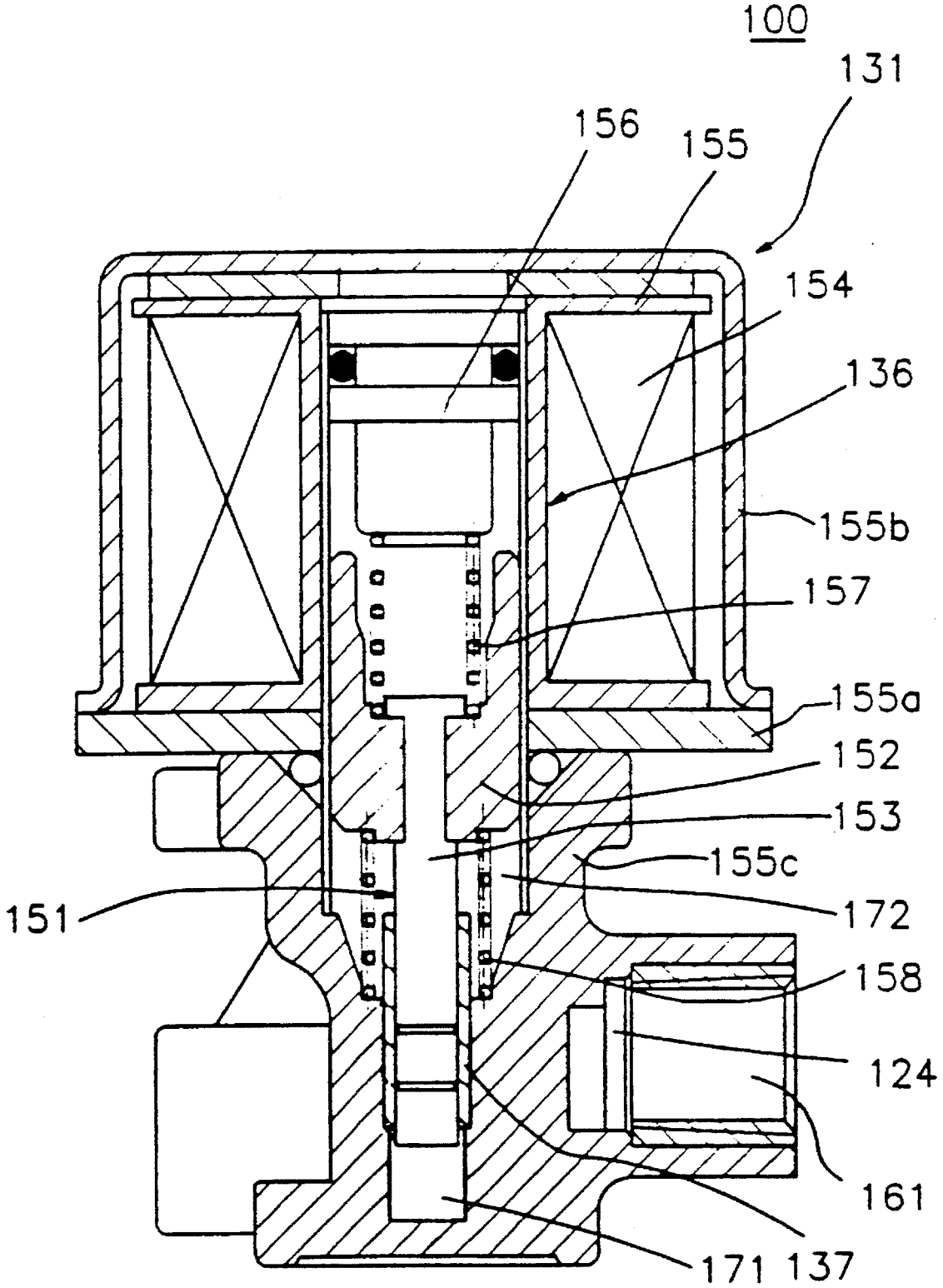
FIG. 3 is a sectional view of the electromagnetic pump taken along a line M—M in FIG. 2.
Figure 4:
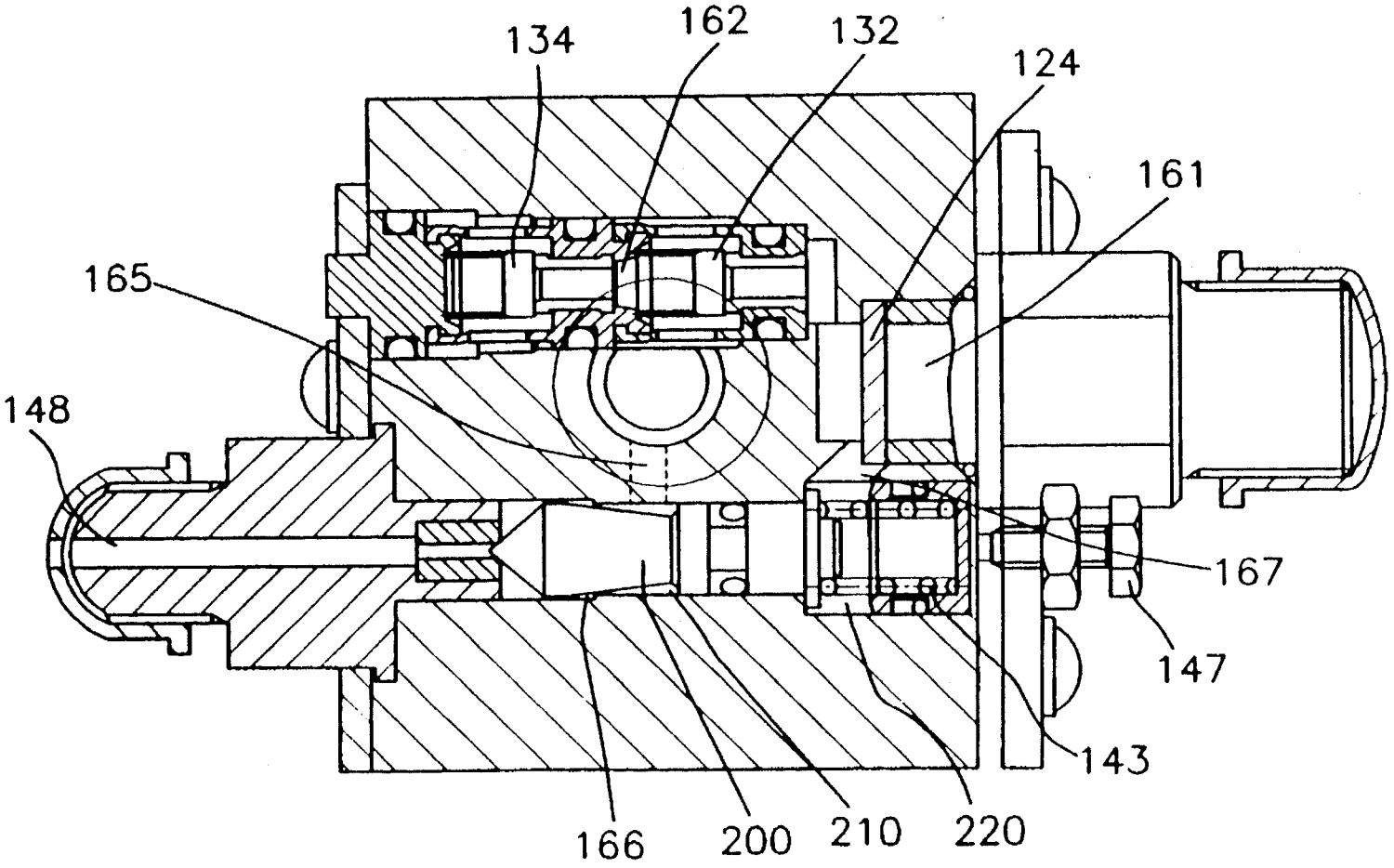
FIG. 4 is a sectional view of the electromagnetic pump taken along a line N—N in FIG. 2.

FIG. 2 is a side elevation of electromagnetic pump 100 having the hydraulic circuit shown in FIG. 1, and FIGS. 3 and 4 are side and plan sectional views of the electromagnetic pump taken along lines M—M and N—N in FIG. 2, respectively.

Referring to FIG. 2, suction section 120 and exhaust section 140, and suction check valve 132 and exhaust check valve 134 are disposed under actuating section 131.

As shown in detail in FIG. 3, actuating section 131 includes a hollow first cylinder 136. First cylinder 136 has a bobbin 155, a support plate 155*a* disposed beneath bobbin 155 and in close contact therewith, and a first neck 155*c* disposed beneath and incorporated with support plate 155*a*.

Bobbin 155 has a solenoid 154 wound on an outer surface thereof. A cap 155*b* enclosing bobbin 155 and solenoid 154 is disposed on support plate 155*a*.

A hollow second cylinder 137 is fitted in a hole formed at a lower part of first cylinder 136. Second cylinder 137 has a smaller diameter than that of first cylinder 136.

First cylinder 136 further has a magnetic core 156 secured in bobbin 155, and a plunger assembly 151 movably disposed under magnetic core 156.

Plunger assembly 151 includes a plunger 152 and a piston 153 formed integrally with plunger 152 and extended downward thereof. One end of piston 153 is inserted in second cylinder 137 so as to move reciprocally therein. A first space and a second space 171 and 172 isolated from each other by piston 153 are formed under and above second cylinder 137, respectively. A first spring 157 is disposed between magnetic core 156 and plunger 152, and a second spring 158 is disposed between plunger 152 and the bottom of first cylinder 136.

First space 171 formed under piston 153 is interconnected to a third oil path 163 branched out from second oil path 162, and exhaust check valve 134 is interconnected through fourth oil path 164 with second space 172 formed above piston 153. Suction check valve 132 and exhaust check valve 134 are valves for permitting fluid to flow in only one direction and are arranged in such a manner to permit the oil to flow in the same direction as shown in FIG. 1. In addition, an air bleeder valve 138 for exhausting air contained in pressurized oil by means of the difference between the viscosity of the oil and the air is disposed in oil path 164.

Meanwhile, as shown in detail in FIG. 4, actuating section 131 has an exhaust chamber 210 defined at a lower side thereof in which exhaust-control valve 200 is disposed. Exhaust chamber 210 is interconnected through fifth oil path 165 to second space 172.

Figure 5:
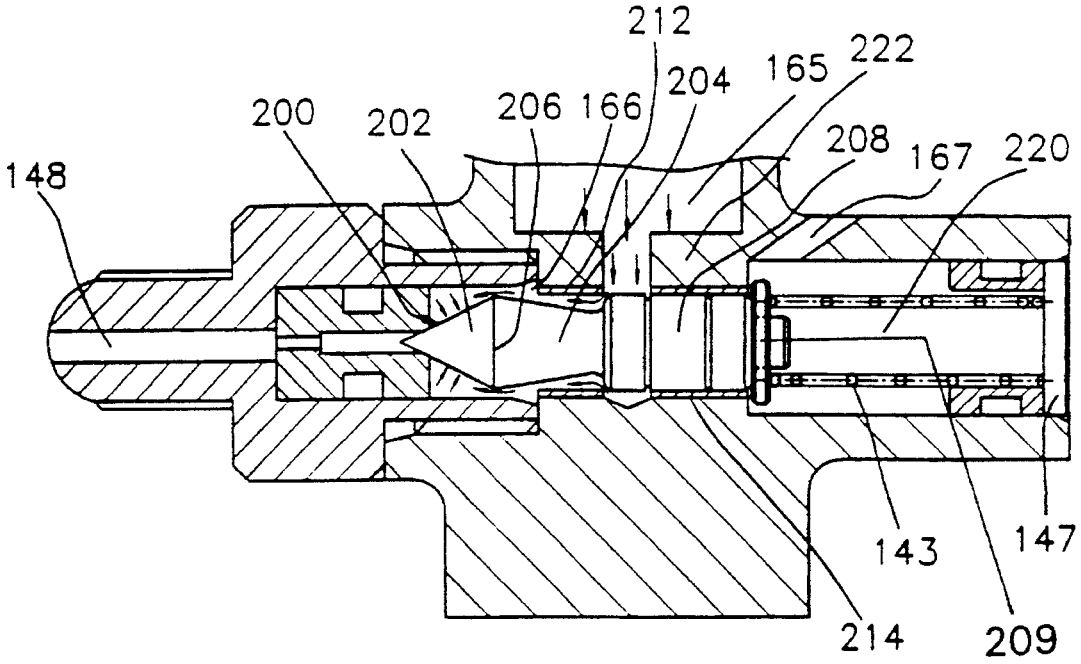
FIGS. 5 and 6 are enlarged views of the exhaust-control valve shown in FIG. 2, respectively, showing the initial and operating positions thereof.
Figure 6:
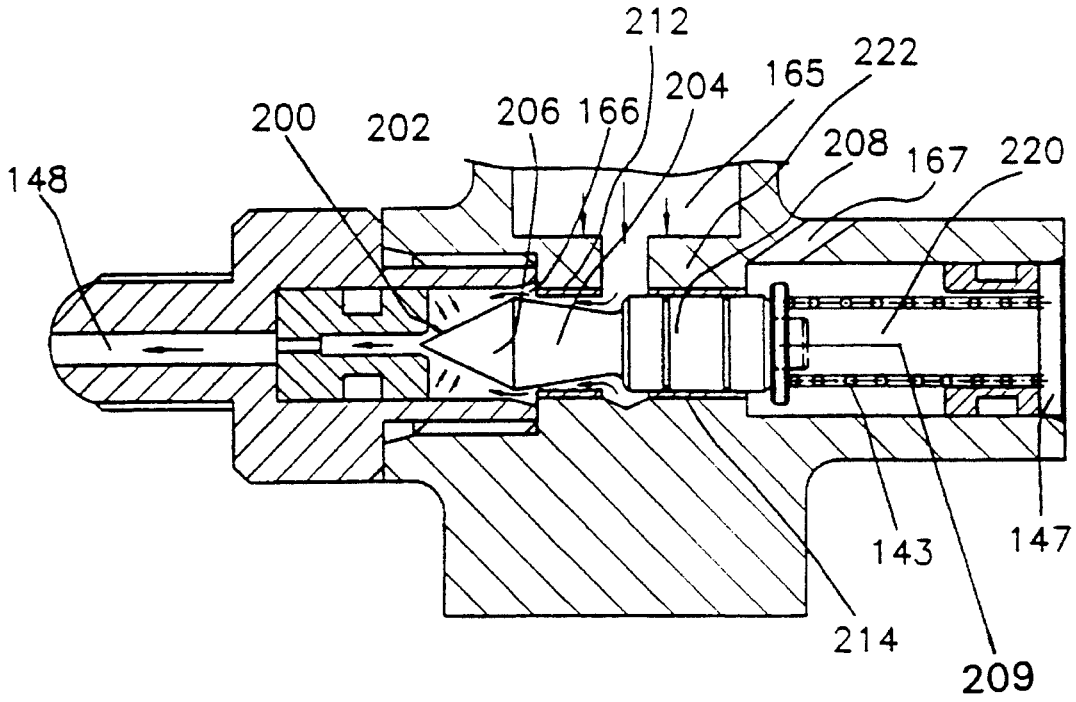
Figure 7:
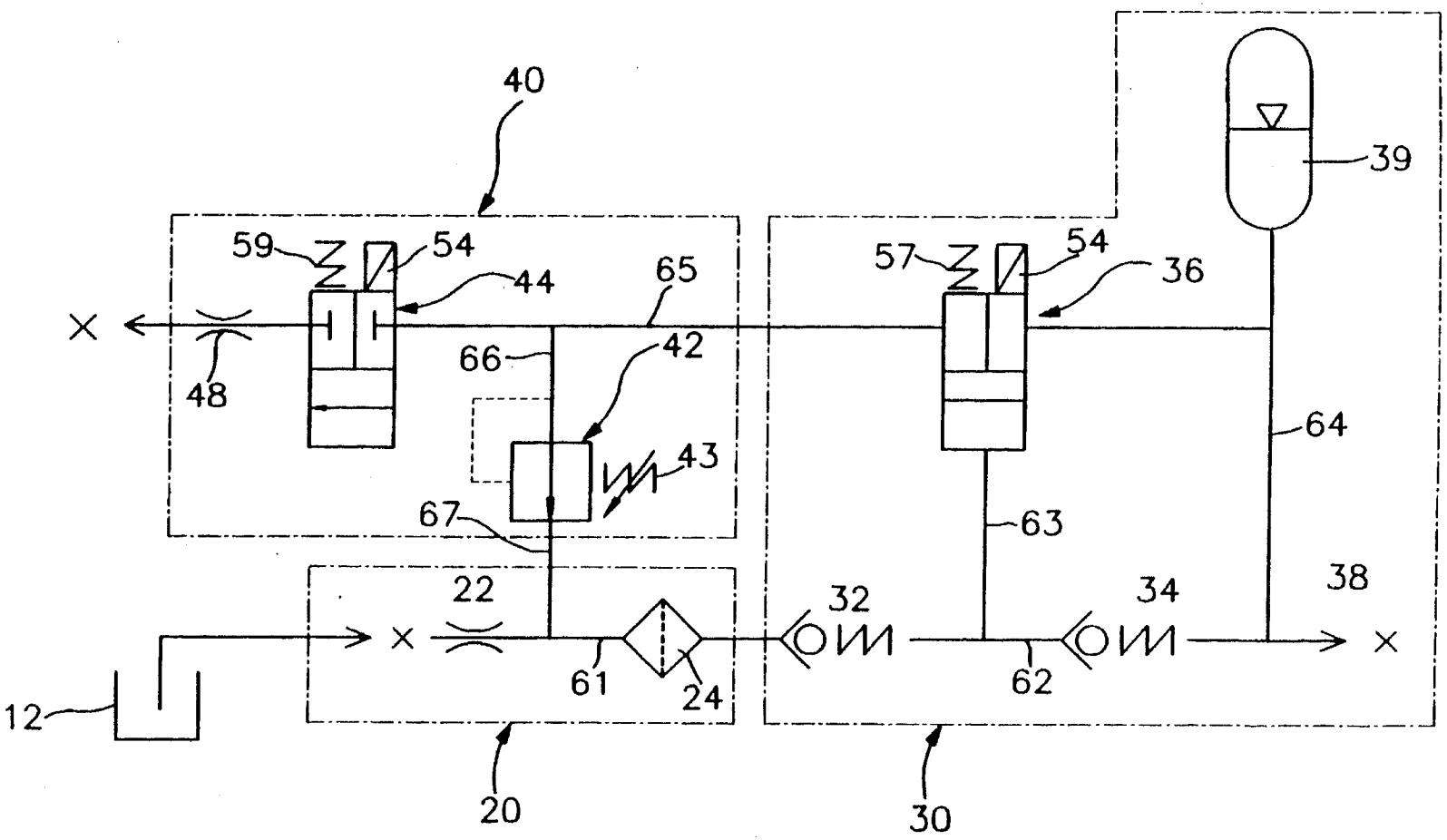
FIG. 7 (PRIOR ART)
FIG. 7 is a hydraulic circuit diagram of a conventional electromagnetic pump.
Figure 8:
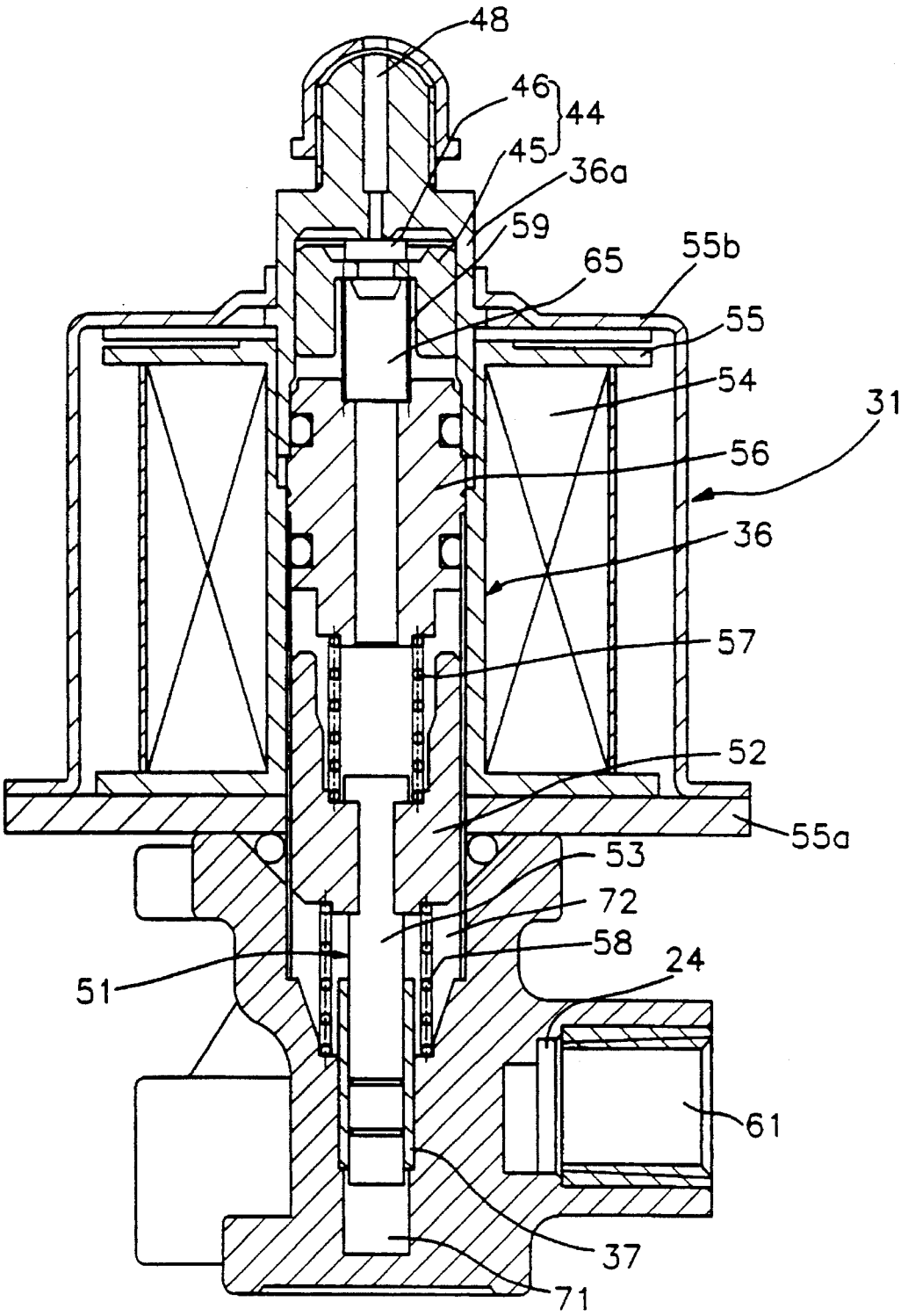
FIG.8 (PRIOR ART)
FIGS. 8 and 9 are side and plan sectional views of the electromagnetic pump shown in FIG. 7, respectively.
Figure 9:
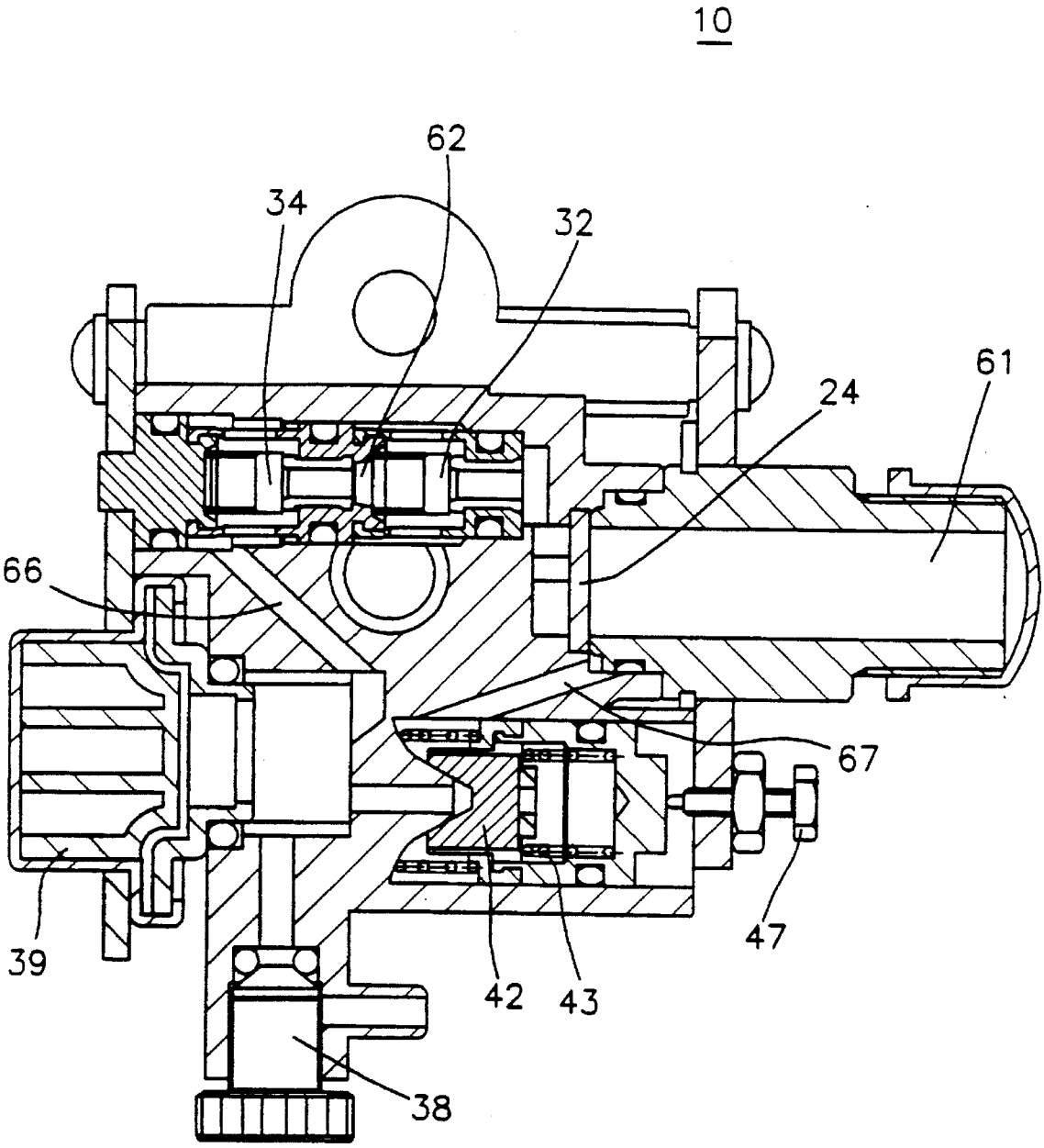
FIG.9 (PRIOR ART)

As more detailedly shown in FIGS. 5 and 6, exhaust-control valve 200 has a conical head 202, a tapered cylindrical body 204 incorporated with head 202, and a guide tail 208 incorporated to the rear end of body 204. Guide tail 208 is supported by third spring 143 and guides forward and backward movement of exhaust-control valve 200. Guide tail 208 has a flange 209 fixed at the rear end thereof. Flange 209 is in contact with third spring 143.

Body 204 is so tapered as to have a decreasing diameter from the front end to the rear end thereof, and thereby a threshold 206 whose diameter is largest in exhaust-control valve 200 is formed between head 202 and body 204. As apparent from FIGS. 5 and 6, the taper of conical head 202 is larger than that of body 204. These tapers determine the condition of the automatic alternating forward and backward movement of exhaust-control valve 200, and thereby proper adoption of them is preferred. In practice, an exhaust-control valve 200 in which tapers of head 202 and body 204 are respectively 45 degrees and 7 degrees has exhibited a superior function.

Third spring 143 for applying an adjustable biasing force to exhaust-control valve 200 is disposed in a back pressure chamber 220 formed behind exhaust chamber 210. Back pressure chamber 220 is interconnected through a seventh oil path 167 to first oil path 161. Third spring 143 is supported by an adjustor 147 disposed at the rear end thereof. The biasing force of third spring 143 can be adjusted by adjustor 147.

Meanwhile, a cylindrical guide hole 214 is formed through a partition wall 222 between exhaust chamber 210 and back pressure chamber 220. Guide tail 208 is closely fitted in guide hole 214 so as to be guided therethrough. Exhaust chamber 210 and back pressure chamber 220 are separated from each other by the close contact between guide tail 208 and guide hole 214. However, a small amount of oil can unexpectedly leak from exhaust 210 chamber into back pressure chamber 220, and then it can be retrieved through seventh oil path 167.

A second neck 212 narrower than exhaust chamber 210 is provided between exhaust chamber 210 and fifth oil path 165. Tapered cylindrical body 204 is disposed in second neck 212, so that a sixth oil path 166 is formed between second neck 212 and body 204. A sectional area in sixth oil path 166 is changed according to the forward and backward movement of exhaust-control valve 200.

As described above, second oil path 162 between suction check valve 132 and exhaust check valve 134 is interconnected through third oil path 163 to first space 171, and exhaust check valve 134 is interconnected through fourth oil path 164 to second space 172 in the present embodiment.

Meanwhile, according to another aspect of the present invention, exhaust check valve 134 may be provided incorporating with plunger assembly 151 without fourth oil path 164, and first space 171 may directly constitute second oil path 162 without third oil path 163. In this case, the opening and closing of exhaust check valve 134 can be smoother because of its cooperation with the movement of plunger assembly 151 due to an inertial force applied to a poppet provided in exhaust check valve 134.

Hereinafter, the operation of the above described electromagnetic pump will be described.

First, when electric power is applied to solenoid 154, magnetic core 156 is magnetized and thereby plunger assembly 151 is elevated toward magnetic core 156. In this case, first space 171 under piston 153 is expanded, and accordingly the pressure in second oil path 162 connected thereto decreases. Then, suction check valve 132 is open and exhaust check valve 134 is closed, and at the same time, oil is sucked from oil reservoir 112 through suction nozzle 122, first oil path 161, suction filter 124, and suction check valve 132 into second oil path 162.

Meanwhile, when electric power having been applied to solenoid 154 is ceased, plunger assembly 151 moves downward by means of biasing force of first spring 157. In this case, second spring 158 keeps plunger assembly 151 from being excessively pushed downward in first cylinder 136, so that plunger assembly 151 can be maintained in the range of electromagnetic force of magnetic core 156.

As plunger assembly 151 moves downward, the volume of first space 171 is reduced so that the pressure in second oil path 162 interconnected thereto is increased. Accordingly, suction check valve 132 is closed and exhaust check valve 134 is open, while the oil pressurized in first space 171 flows through exhaust check valve 134 and fourth oil path 164 into second space 172. Then, the pressurized oil flows from second space 172 through fifth oil path 165 into exhaust chamber 210. Air contained in pressurized oil can be exhausted through air bleeder valve 138 while passing through fourth oil path 164.

The above-described process is periodically repeated whenever such applying and cutting off of an electric power alternates. The pressure in fifth oil path 165, or in exhaust chamber 210, is increased according to this periodical repetition, and acts as a force pushing the front face of conical head 202 backward.

In an initial stage, exhaust control valve 200 blocks off exhaust nozzle 148 interconnected to exhaust chamber 210 until the increasing pressure reaches a predetermined value, that is, the sum of an initial biasing force or compression force of third spring 143 and a back pressure applied to the back of exhaust control valve 200 through seventh oil path 167 as shown in FIG. 5. In this case, the above initial compression force can be adjusted by handling adjustor 147, and accordingly the exhaust pressure of an electromagnetic pump can be indirectly adjusted by the above adjustment of the initial compression force.

When the pressure of oil in exhaust chamber 210 having been increased exceeds the sum of the initial compression force and the back pressure, exhaust-control valve 200 is moved backward while forcing third spring 143 backward as shown in FIG. 6. In this case, oil of back pressure filled in back pressure chamber 220 dampens the movement of exhaust-control valve 200.

According to this continuous pressure increase by the continual alternating of plunger assembly 151, exhaust-control valve 200 continues to move backward, and accordingly threshold 206 moves backward so that sixth oil path 166 between second neck 212 and body 204 gradually becomes narrower. That is, a sectional area at a position or an area of a control surface in sixth oil path 166 decreases.

Meanwhile, a flow equation of oil flowing through an oil path is expressed as follows:

$$Q = Cd \times A \times \sqrt{\frac{2 \times \delta P}{\rho}}$$

In the above equation, Q, Cd, A, δP, and ρ respectively mean the quantity of the oil, a flow coefficient, a sectional area of an oil path, the pressure difference between the initial and the final ends of the oil path, and the density of the oil. The sectional area A is inversely proportional to the pressure difference or pressure drop δP through the oil path. That is, the pressure drop through sixth oil path 166 increases according to the above described decrease of a sectional area of sixth oil path 166. In other words, the narrower the sixth oil path 166 becomes by the backward movement of exhaust-control valve 200, the smaller the oil pressure applied to conical head 202 becomes.

When the oil pressure having been decreased becomes lower than a sum of the back pressure and a control compression force of third spring 143, exhaust-control valve 200 moves forward again. At this point, the sectional area of sixth oil path 166 increases again and accordingly the oil pressure applied to conical head 202 increases again. When this increasing oil pressure exceeds the back pressure and the control compression force of third spring 143, exhaust-control valve 200 moves backward again.

While the oil is exhausted through exhaust nozzle 148, exhaust-control valve 200 repeatedly moves forward and backward as described above, so as to maintain the pressure of the exhausted oil constant. In this case, because the forward and backward movement of exhaust-control valve 200 is controlled by the inverse proportional variations of the oil pressure applied to conical head 202 and the compression force of third spring 143 and by the interaction therebetween, the movement is very fine, and thereby the pulse of the exhausted oil is very minute.

In other words, exhaust-control valve 200 sensitively responds to a pressure of the pressurized oil and does not completely block off exhaust nozzle 148 while the oil is exhausted through exhaust nozzle 148, and accordingly the exhaust of oil through exhaust nozzle 148 is not intermittent and pulse or fluctuation of the pressure of the exhausted oil is greatly reduced.

Through the above-described process, the pressure of the oil exhausted through exhaust nozzle 148 is maintained near the sum of the back pressure and the control compression force of third spring 143. The back pressure is so small compared with the compression force of third spring 143 as to be nearly negligable. As described above, the exhaust pressure of the oil can be controlled through indirect adjustment of the control compression pressure of third spring 143 by adjusting the initial compression force of third spring 143.

Meanwhile, the exhaust pressure of the oil is transmitted to development section 130 in the above-described process, and accordingly energy for pressurizing the oil is saved. That is, when plunger assembly 151 moves upward, a downward force equal to the multiple of the sectional area of piston 153 and pressure difference between first and second spaces 171 and 172 is applied on piston 153 or plunger assembly 151. The pressure difference increases according to the increase of the exhaust pressure, so the upward movement of plunger assembly 151 is reduced and thereby the energy for moving the plunger assembly 151 upward is reduced.

Further, when plunger assembly 151 moves downward, the exhaust pressure is transmitted through fifth oil path 165 and open exhaust check valve 134, so that the downward movement of plunger assembly 151 is reduced and thereby the energy for moving the plunger assembly 151 downward is reduced. In other words, while a redundant oil is returned through the relief valve to the suction section of back pressure and is recirculated in the conventional electromagnetic pump, the pressurized oil is not returned to suction section 120 but the exhaust pressure of the oil is directly transmitted to development section 130 so that the energy for pressurizing the oil is saved in development section 130 in an electromagnetic pump according to the present invention.

Meanwhile, when power supply to solenoid 154 is cut off to stop the operation of the electromagnetic pump and extinguish a burner connected thereto, the alternating movement of plunger assembly 151 is stopped. Then, the supply of oil through fifth oil path 165 from development section 130 is stopped, and oil remaining in exhaust chamber 210 is exhausted through exhaust nozzle 148 while the exhaust pressure decreases abruptly, and then exhaust-control valve 200 moves forward and tightly blocks off exhaust nozzle 148 by third spring 143 having a very large compression force. In this case, the remaining oil of low pressure does not leak into exhaust nozzle 148 but only remains in exhaust chamber 210 and fifth oil path 165 due to such a large compression force. Therefore, leakage of remaining oil after extinction of a burner is prevented, and thereby incomplete combustion is prevented.

As described above, in the electromagnetic pump according to the present invention, the pressurized oil is not exhausted through an exhaust valve intermittently open and closed by operation of a solenoid, but the quantity and the pressure of the exhausted oil is automatically controlled by exhaust-control valve 200 responding to the pressurized oil, and thereby the fluctuation or pulsation of exhausted oil is greatly reduced and the exhaust of oil is relatively uniform. Therefore, a separate element for reducing pulsation of exhausted oil such as a buffer is not required. Further, waste of energy for recirculating redundant oil is prevented.

Moreover, operational noise is greatly reduced because an exhaust valve open and closed over 60 times per second by alternating current over 60 Hz is not adopted.

Furthermore, leakage of oil through exhaust-control valve is prevented after power supply to the solenoid is ceased and running of burner has been finished, and thereby so-called fire-extinction delay is prevented.

In addition, in the electromagnetic pump according to the present invention, both exhaust chamber 210 and exhaust nozzle 148 are not disposed at an upper portion of first cylinder 136 but under cylinder 136. That is, the electromagnetic pump according to the present invention adopts a side-exhausting mode, not an upward-exhausting mode. Therefore, necessity for a separate air bleeder valve is reduced. Further, impact noise due to the air included in oil is reduced.

Furthermore, the efficiency of energy may be improved by reducing a magnetic void in transferring the magnetic flux or the magnetic force for operating plunger assembly 151.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. An electromagnetic pump comprising:

a suction section for introducing oil from an oil reservoir;

a development section for pressurizing the oil introduced from the suction section to elevate the pressure of the oil; and an exhaust section including controlling means for controlling the pressure elevating capability of the development section by transmitting the elevated pressure to the development section to thereby maintain a constant pressure, an exhaust nozzle for guiding an exhaust of the oil which has passed the controlling means, and setting means for setting and adjusting the exhaust pressure which is maintained constant by the controlling means;

the controlling means including an exhaust chamber having a first end open to the development section via an oil path to receive the oil from the development section and a second end open to the exhaust nozzle, and an exhaust control valve disposed within the exhaust chamber;

wherein the exhaust-control valve has a conical head at one end side, a cylindrical body integrally connected to the conical head, the cylindrical body having a tapered shape whose diameter decreases towards a rear side of the cylindrical body away from the conical head, a threshold between the conical head and the cylindrical body, and a guide tail integrally connected to the rear side of the cylindrical body for guiding reciprocating movement of the exhaust control valve.

2. The electromagnetic pump as claimed in claim 1, wherein the exhaust chamber has a neck formed between the exhaust chamber and the oil path, the neck having a diameter less than that of the exhaust chamber, and wherein the cylindrical body is located in the neck so that another oil path is formed between the cylindrical body and the neck, a sectional area of the another oil path being varied in accordance with the reciprocating movement of the exhaust-control valve.

3. The electromagnetic pump as claimed in claim 2, wherein the setting means has a back pressure chamber isolated from the exhaust chamber, a spring is provided within the back pressure chamber for applying a biasing force to the exhaust-control valve, and an adjuster for adjusting the biasing force of the spring.

4. The electromagnetic pump as claimed in claim 3, the exhaust-control valve further comprising a flange fixed to a rear end of the guide tail and supported by the spring.

5. The electromagnetic pump as claimed in claim 4, wherein a taper angle of the conical head is greater than an angle of the cylindrical body.

6. The electromagnetic pump as claimed in claim 4, wherein a taper angle of the conical head is 45 degrees and a taper angle of the cylindrical body is 7 degrees.

7. The electromagnetic pump as claimed in claim 3, wherein a cylindrical guide hole is formed between the exhaust chamber and the back pressure chamber, and the guide tail is inserted in the cylindrical guide hole to be guided therein while being in close contact therewith so that the exhaust chamber and the back pressure chamber are isolated from each other.

8. The electromagnetic pump as claimed in claim 3, wherein the back pressure chamber is open to the suction section via an oil path.

9. An electromagnetic pump comprising:

a suction section including a suction nozzle interconnected to an oil reservoir for introducing the oil therefrom, and a suction filter coupled to the suction nozzle via a first oil path;

a development section including a suction check valve for receiving the oil introduced from the suction section, an exhaust check valve for exhausting the oil from the suction check valve, the exhaust check valve being interconnected to the suction check valve via a second oil path, and an actuating section for pressurizing the oil introduced through the suction check valve so as to increase the pressure of the oil and for exhausting the oil through the exhaust check valve, the suction check valve and the exhaust valve being so arranged as to allow the oil to flow only in an identical direction, the actuating section having a first cylinder of a hollow type, a plunger assembly movably provided in the first cylinder, means for reciprocating the plunger assembly in the first cylinder, and a first space open to the second oil path and a second space open to the exhaust check valve so as to receive the oil from the exhaust check valve, the first space and the second space having volumes which vary alternatively from each other in accordance with the reciprocating movement of the plunger assembly, the first cylinder having a bobbin, a support plate integrally assembled with a lower portion of the bobbin, a first neck integrally assembled with a lower portion of the bobbin, a first neck integrally assembled with a lower portion of the support plate, a cap provided on an upper portion of the support plate so as to cover the bobbin and the solenoid, and a second cylinder fixed to a lower portion of the first cylinder, wherein the second cylinder has a diameter less than that of the first cylinder, the reciprocating means including a magnetic core fixed in the center of the bobbin, a solenoid wound on an outer surface of the bobbin for generating a magnetic force of the magnetic core to thereby move the plunger assembly when an electric current is applied thereto, a first spring provided between the magnetic core and the plunger assembly for applying the plunger assembly with a biasing force, and a second spring provided between the plunger assembly and an inner surface of the first cylinder for applying the first cylinder with an biasing force so as to maintain the plunger assembly within a magnetic range of the magnetic core, the plunger assembly having a plunger and a piston integrally connected to the plunger and being extended from a center portion of the plunger, the piston being inserted in the second cylinder so as to reciprocate in the second cylinder;

the first space and the second space being respectively formed at both ends of the second cylinder, and the first space and the second space being isolated from each other by the piston, the first space being open to a third oil path branched out from the second oil path, and the second space being open to the exhaust check valve via a fourth oil path, an air bleeder valve being connected to the fourth oil path; and an exhaust section including means for controlling the pressure elevating capability of the development section by transmitting the elevated pressure to the development section to thereby maintain a constant exhaust pressure, an exhaust nozzle for guiding an exhaust of the oil which has passed the controlling means, and setting means for setting and adjusting the exhaust pressure which is maintained constant by the controlling means, the controlling means including an exhaust chamber having a first end open to the second space via a fifth oil path so as to receive the oil from the second space and a second end open to the exhaust nozzle, and an exhaust-control valve disposed within the exhaust chamber, the exhaust-control valve having a conical head at one end side, a cylindrical body integrally connected to the conical head, the cylindrical body having a tapered shape whose diameter decreases as it goes to a rear side from the conical head and the cylindrical body, a guide tail integrally connected to a rear side of the cylindrical body for guiding reciprocating movement of the exhaust-control valve, and a flange fixed to a rear end of the guide tail, the exhaust chamber having a second neck formed between the exhaust chamber and the fifth oil path, the second neck having a diameter less than that of the exhaust chamber, and the body being located in the second neck so that a sixth oil path is formed between the body and the second neck, a section area of the sixth oil path being varied in accordance with the reciprocating movement of the exhaust-control valve, the setting means including a back pressure chamber isolated from the exhaust chamber, a third spring provided within the back pressure chamber and being in contact with the flange for applying a biasing force to the exhaust-control valve, and an adjustor for adjusting the biasing force of the third spring, wherein a cylindrical guide hole is formed between the exhaust chamber and the back pressure chamber, a taper angle of the conical head is greater than the angle of the cylindrical body, the guide tail being inserted in the cylindrical guide hole to be guided therein while being in close contact therewith so that the exhaust chamber and the back pressure chamber are isolated from each other, the back pressure chamber being open to the suction section via a seventh oil path.

* * * * *